US006560436B1

(12) United States Patent
Liu

(10) Patent No.: US 6,560,436 B1
(45) Date of Patent: May 6, 2003

(54) ELECTRODYNAMIC TRANSFER SYSTEM

(75) Inventor: Chu-heng Liu, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/014,564

(22) Filed: Dec. 14, 2001

(51) Int. Cl.[7] ..... G03G 15/16

(52) U.S. Cl. ..... 399/314; 399/66; 399/308; 430/126

(58) Field of Search ..... 399/66, 297, 302, 399/308, 310, 314; 430/126

(56) References Cited

U.S. PATENT DOCUMENTS 4,473,627 A * 9/1984 Kanbe et al. ..... 399/314 X
5,198,864 A 3/1993 Fletcher ..... 399/314
5,406,359 A 4/1995 Fletcher ..... 399/296
5,428,429 A 6/1995 Fletcher ..... 399/308
6,301,453 B1 10/2001 Tsutsumi ..... 399/55

FOREIGN PATENT DOCUMENTS

JP 06-175509 * 6/1994

* cited by examiner

*Primary Examiner*—Sophia S. Chen
(74) *Attorney, Agent, or Firm*—Mark Z. Dudley

(57) ABSTRACT

Method and apparatus for improved transfer of charged developing material to a substrate in an electrophotographic printing apparatus by applying an oscillatory bias voltage to the charged developing material. The printing apparatus includes a toner transfer system having an intermediate transfer belt and a transfer station having a transfer charging device. The intermediate transfer member is provided with a biasing voltage, generating oscillatory electric fields in the transfer nip. As a result, the portion of the developed image present in the transfer nip is subjected to repeated transfer and back-transfer forces, resulting in fluidization, whereby the developed image is more efficiently transferred.

15 Claims, 2 Drawing Sheets

FIG. 2
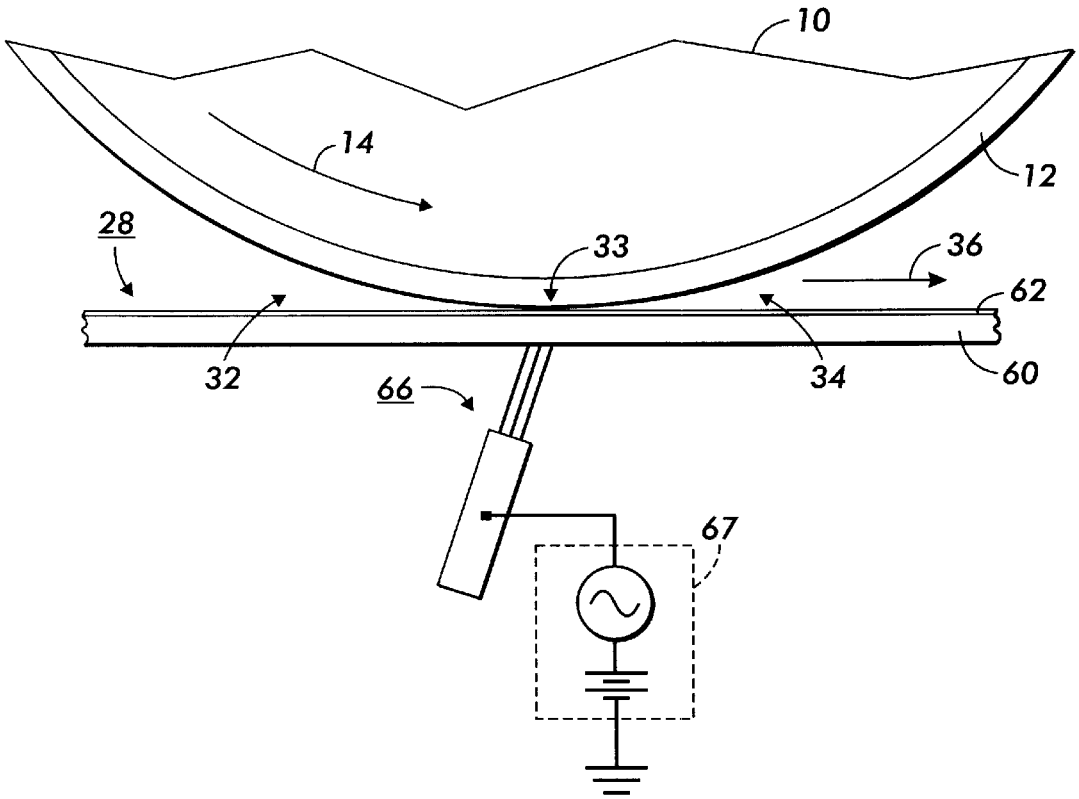
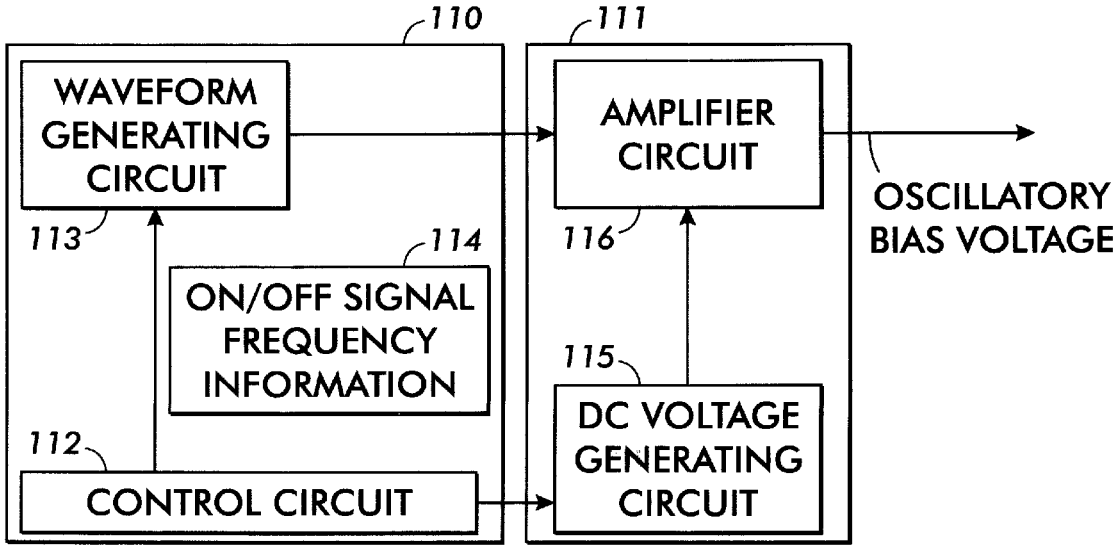
FIG. 3

ELECTRODYNAMIC TRANSFER SYSTEM

The present invention relates generally to a system for transfer of charged toner particles in an electrostatographic printing apparatus, and more particularly concerns a method and apparatus for enabling transfer of charged developing material to an intermediate transfer member by applying an oscillatory bias voltage to the charged developing material.

Generally, the process of electrostatographic image reproduction is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. Charged developing material is subsequently deposited onto the photoreceptive member such that the developing material is attracted to the charged image areas on the photoconductive surface is thereof to develop the electrostatic latent image into a visible image. The developing material is then transferred from the photoreceptive member, either directly or after an intermediate transfer step, to a copy sheet or other support substrate, creating an image which may be permanently affixed to the copy sheet to provide a reproduction of the original document. In a final step, the photoconductive surface of the photoreceptive member is cleaned to remove any residual developing material thereon in preparation for successive imaging cycles.

Analogous processes also exist in other electrostatographic printing applications such as, for example, ionographic printing and reproduction, where charge is deposited in an image pattern on a charge retentive surface in response to electronically generated or stored images, as described in U.S. Pat. Nos. 3,564,556; 4,240,084; and 4,619,515 among others.

The process of transferring developing material from an image support surface to a second supporting surface is typically realized at a transfer station. In a conventional transfer station, transfer is achieved by applying electrostatic force fields in a transfer region sufficient to overcome forces which hold the toner particles to the photoconductive surface on the photoreceptive member. These electrostatic force fields operate to attract and transfer the toner particles over onto the second supporting surface which may be an intermediate transfer belt or an output copy sheet. An intermediate transfer belt is desirable for use in tandem color or one pass paper duplex (OPPD) applications where successive toner powder images are transferred onto a single copy sheet. For example, U.S. Pat. No. 3,957,367 issued to Goel, the disclosure of which is incorporated herein by reference, teaches a color electrostatographic printing machine wherein successive single-color powder images are transferred to an intermediary, in superimposed registration with one another. The resultant multi-layered powder image is subsequently transferred to a sheet of support material to form a color copy of an original document. Color and OPPD systems may also utilize multiple photoconductive drums in lieu of a single photoconductive drum.

Intermediate transfer elements employed in imaging systems of the type in which a developed image is first transferred from the imaging member to an intermediate member and then transferred from the intermediate to an outer copy substrate should exhibit efficient transfer characteristics both for transfer of the developer material from the imaging member to the intermediate as well as for transfer of the developer material from the intermediate to the output copy substrate. Efficiency of transfer is determined by the percentage of the developer material comprising the developed image is transferred with respect to the residual developer remaining on the surface from which the image was transferred. Highly efficient transfer is particularly important when the imaging process entails the creation of full color images by sequentially generating and developing successive images in each primary color and superimposing the developed primary color images onto each other during transfer to the substrate. In particular, undesirable shifting and variation in final colors produced can occur when the primary color images are not efficiently transferred to the substrate.

Conventional transfer of toner images between support surfaces in electrostatographic applications is often accomplished via electrostatic induction or by applying a potential difference between the substrate of a biased member contacting the second supporting member and the image bearing surface originally supporting the toner image layer. Such transfer process focuses on applying and maintaining high intensity electric fields in the transfer region in order to overcome the adhesive forces acting on the toner particles. Careful control of these electric fields is required to induce the physical detachment and transfer-over of the charged particulate toner materials from one surface to a second supporting surface without scattering or smearing of the developer material. The electric fields across the transfer region must be controlled so that the fields are high enough to effect efficient toner transfer while being low enough so as not to cause arcing, excessive corona generation, or excessive toner transfer in the regions prior to intimate contact of the second supporting surface and the toner image. Imprecise and inadvertent manipulation of these electric fields can create copy or print defects by inhibiting toner transfer or by inducing uncontrolled toner transfer, causing scattering or smearing of the toner particles.

Various problems associated with conventional image transfer are well known. Variations in conditions, such as second supporting surface resistivity, contaminants, and changes in the toner charge or in the adhesive properties of the toner materials, can all effect necessary transfer parameters. Further, material resistivity and toner properties can change greatly with humidity and other ambient environmental parameters. In the pre-nip gap or so called pre-nip region, immediately in advance of contact between the substrate surface and the developed image, excessively high transfer fields can result in premature transfer across an air gap, leading to decreased resolution or blurred images. High transfer fields in the pre-nip gap can also cause ionization which may lead to strobing or other image defects, loss of transfer efficiency, and a lower latitude of system operating parameters. Conversely, in the post-transfer nip gap or so called post-nip region, at the photoconductor/second supporting surface separation area, insufficient transfer fields are considered to cause image dropout and may generate hollow characters. Also, improper ionization in the post-nip region may cause image stability defects or can create copy sheet detacking problems.

Induced variations in field strength across the transfer region can be considered contrary to a conventional premise that the transfer fields should be as large as possible in the region directly adjacent to the transfer nip, where the second supporting surface contacts the developed image, so that high transfer efficiency and stable transfer are expected to be achieved.

However, in accordance with the present invention, an apparatus for transferring charged image developer material from an image support surface to a substrate is provided, wherein a substrate is positioned to have at least a portion thereof adjacent the image support surface to define a transfer region including a pre-nip region, a transfer nip, and a post-nip region and a transfer station, located adjacent the transfer region, is provided for establishing an oscillatory voltage potential between the image support surface and the substrate so as to establish an oscillatory electric field in the transfer nip. The induced oscillatory electric field is of the appropriate field strength and exhibits an oscillatory (bidirectional) component having alternating polarity and a constant (unidirectional) component having a single polarity that is appropriate for the ultimate toner transfer direction, so as to cause repeated transfer and back transfer of the toner within the transfer nip in a fluidized motion to and from the substrate. The oscillatory mode of the applied oscillatory electric field diminishes to a selected level, such that the constant component is sufficient to effect high transfer efficiency in the ultimate toner transfer.

These and other aspects of the present invention will become apparent from the following description in conjunction with the accompanying drawings, in which:

FIG. 2 is an enlarged schematic side view of a preferred embodiment of the transfer station of FIG. 1 showing a transfer nip biasing device.

FIG. 3 is a schematic showing the biasing source for effecting an oscillatory bias voltage in the transfer station of FIG. 2.

Figure 1:
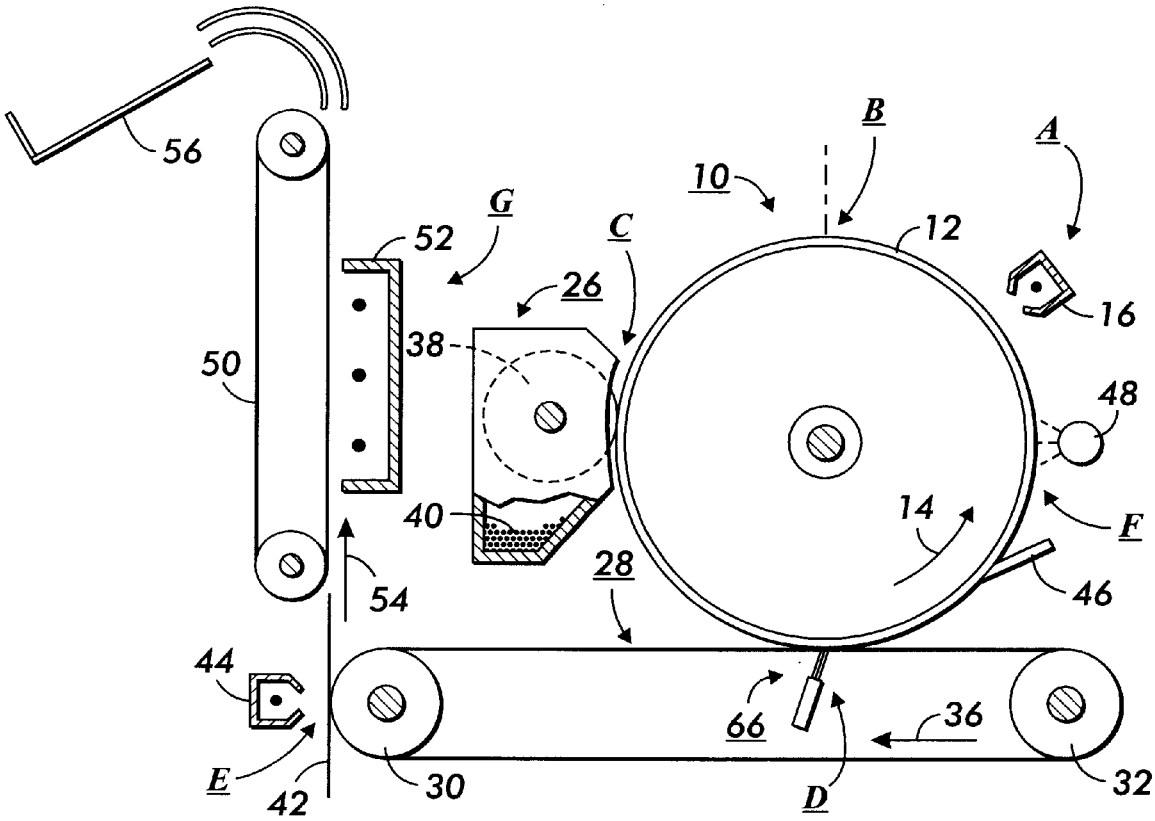
FIG. 1 is a schematic elevational view illustrating an exemplary electrostatographic printing machine incorporating the features of the present invention.

While the present invention will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the following detailed description progresses, with specific reference to the drawings wherein like reference numerals have been used throughout the drawings to designate identical elements therein.

For a general understanding of an exemplary electrostatographic printing machine incorporating the features of the present invention, reference is made to FIG. 1 which schematically depicts the various components thereof. It will become apparent from the following discussion that the transfer assembly of the present invention is equally well-suited for use in a wide variety of electroreprographic machines, as well as a variety printing, duplicating and facsimile devices.

The electrophotographic printing apparatus employs an image support surface provided in the form of a highly conductive drum 10 having a photoconductive layer 12 deposited thereon. The photoconductive layer 12 provides an image support surface mounted on the exterior circumferential surface of drum 10 and entrained thereabout. A series of processing stations are positioned about drum 10 which is driven in the direction of arrow 14 at a predetermined speed relative to the other machine operating mechanisms by a drive motor (not shown), to transport the photoconductive surface 12 sequentially through each station. Timing detectors (not shown) sense the rotation of drum 10 and communicate with machine logic to synchronize the various operations thereof so that the proper sequence of events is produced at the respective processing stations.

Initially, drum 10 rotates the photoconductive layer 12 through charging station A. At charging station A, a charging device which may include a corona generating device, indicated generally by the reference numeral 16, which sprays ions onto photoconductive surface 12 producing a relatively high substantially uniform charge thereon.

Once charged, drum 10 is rotated to exposure station B where a light image of an original document is projected onto the charged portion of the photoconductive surface 12. A scanning beam B incrementally scans successive portions of image information onto the photoconductive surface of photoconductive layer 12. This process selectively dissipates the charge on the photoconductive layer 12 to record an electrostatic latent image corresponding to the information onto the photoconductive surface of photoconductive layer 12. The beam may be provided from a light lens system or other devices (not shown), such as a raster output scanner (ROS) for providing a modulated laser beam, that may be employed to selectively discharge the charged portion of the photoconductive surface to record the electrostatic latent image thereon.

After exposure, drum 10 rotates the electrostatic latent image recorded on the surface of photoconductive layer 12 to development station C. Development station C includes a developer unit, generally indicated by the reference numeral 26, comprising a magnetic brush development system for depositing developing material onto the electrostatic latent image. Magnetic brush development system 26 preferably includes a single developer roller 38 disposed in a developer housing 40. In the developer housing 40, toner particles are mixed with carrier beads, generating an electrostatic charge therebetween and causing the toner particles to cling to the carrier beads to form developing material. Developer roller 38 rotates and attracts the developing material, forming a magnetic brush having carrier beads and toner particles magnetically attached thereto. Subsequently, as the magnetic brush rotates, the developing material is brought into contact with the photoconductive surface 12, the electrostatic latent image thereon attracts the charged toner particles of the developing material, and the latent image on photoconductive surface 12 is developed into a visible toner image.

At transfer station D, the developed image is electrostatically transferred to a substrate such as an intermediate member or belt indicated generally by the reference numeral 28. Belt 28 is entrained about spaced rollers 30 and 32, respectively, being transported thereabout in the direction of arrow 36. Preferably, belt 28 contacts drum 10 to form a transfer nip where the developed image on photoconductive surface 12 is transferred onto belt 28. In the illustrated embodiment, a bias transfer brush 66 is provided for providing an oscillatory electric field in the transfer nip. The details of the transfer process, and the specific features of the transfer apparatus of the present invention will be discussed in greater detail with reference to FIGS. 1–2.

As belt 28 advances in the direction of arrow 36, the toner image transferred thereto advances to transfer station E where copy sheet 42 is advanced, in synchronism with the toner particle image on belt 28, for transfer of the image to output copy sheet. Transfer station E includes a corona generating device 44 which causes the toner particles to be attracted from belt 28 to copy sheet 42 in image configuration. It will be understood that various transfer devices or systems, including one similar to the transfer system of the present invention, can be implemented for utilization at transfer station E.

After the toner particles are transferred to copy sheet 42, the copy sheet advances on conveyor 50 through fusing station G. Fusing station G includes a radiant heater 52 for radiating sufficient energy onto the copy sheet to permanently fuse the toner particles thereto in image configuration. Conveyor belt 50 advances the copy sheet 42, in the direction of arrow 54, through radiant fuser 52 to catch tray 56 where the copy sheet 42 may be readily removed by a machine operator.

A very small amount of residual carrier beads and toner particles may remain adhered to photoconductive surface 12 of drum 10 after transfer of the image to belt 28. These residual particles and carrier beads are removed from photoconductive surface 12 at cleaning station F. Cleaning station F includes a flexible, resilient blade 46, having a free end portion placed in contact with photoconductive layer 12 to remove any material adhering thereto. Thereafter, lamp 48 is energized to discharge any residual charge on photoconductive surface 12 in preparation for a successive imaging cycle. The foregoing description should be sufficient for the purposes of the present application for patent to illustrate the general operation of an electrophotographic image reproduction apparatus incorporating the features of the present invention. As described, an electrophotographic apparatus may take the form of any of several well known devices or systems. Variations of specific electrostatographic processing subsystems or processes may be expected without affecting the operation of the present invention.

Referring now specifically to FIG. 2, the transfer station of the present invention and the particular structure thereof will be discussed in detail. FIG. 2 provides an enlarged detailed view of transfer station D in a cross-sectional plane extending along the direction of motion of the photoconductive drum 10 and perpendicular to the intermediate transfer belt 28. A transfer nip is formed at the point of contact between the photoconductive imaging surface of the photoconductive layer 12 of xerographic drum 10 and the intermediate transfer belt 28. The intermediate transfer belt travels through the nip, moving into and out of engagement with the imaging surface of drum 10 where the toner powder image thereon is transferred to the intermediate transfer belt 28. The curvature of the imaging surface of the drum 10 relative to the intermediate transfer belt 28 defines a transfer region including a transfer nip 33 as well as a pre-transfer nip region 32 and a post-transfer nip region 34 located adjacent to the transfer nip along the upstream and downstream sides thereof, respectively.

The intermediate transfer belt 28 comprises a transferred image support layer 62 supported on a backing substrate 60. Transferred image support layer 62 may be comprised of a photoconductive material or an insulative substrate. The backing substrate 60 may be formed of resistive selective materials that permit substantial charge relaxation during transfer nip dwell time while having sufficient lateral resistance to allow different potentials to be applied along the length of the intermediate belt 28. A semiconductive belt may also be used provided its dielectric thickness is properly selected. Ongoing work on materials for use in bias transfer rolls would likely disclose many alternative materials that would be applicable for use in the present invention. It is further noted that the intermediate transfer belt 28 of the present invention can be fabricated as a single layer structure so long as appropriate conductivity is provided. Electrostatic image transfer from the xerographic drum 10 to the intermediate transfer belt 28 is accomplished by the transfer station, for inducing an oscillatory electric field in the transfer nip, located at the point of contact between photoconductive surface 12 and the intermediate transfer belt 28. The oscillatory electric field may be applied by suitable biasing means, including but not limited to, an electrode assembly, a corona generating device, or a bias transfer roll.

In the preferred embodiment of the present invention, electrostatic image transfer to the intermediate transfer belt 28 is accomplished via an electrode assembly in the form of a biased blade brush 66 coupled to biasing source 67. The biased blade brush 66 contacts the substrate 60 opposite the transfer nip to provide an applied potential difference between the intermediate belt 28 and the photoconductor drum 10. The applied voltage potential of the biased blade 66 in the transfer nip will be selected to create sufficiently high electric fields of the appropriate oscillatory field strength and alternating polarity to cause repeated transfer and back transfer of the toner within the transfer nip in a fluidized motion to and from the intermediate transfer belt 28. Typically, fields in the transfer nip that are above 20 volts/micron are necessary and frequently fields on the order of 40 volts/micron or higher are required, depending on such factors as toner adhesion, toner charge, toner mass to be transferred, etc.

It will be noted that a bias potential can be applied to the conductive substrate of drum 10 to provide a supplemental applied potential difference between the conductive substrate of drum 10 and the intermediate transfer belt 28 to enhance transfer field generation, as appropriate. In further discussion herein, the voltages on the conductive biased blade member acting on the intermediate belt 28 will be assumed to be referenced to the potential on the conductive substrate of drum 10, and the reference potential of the conductive substrate of drum 10 will further be assumed to be zero, strictly for convenience of further discussion. It will be appreciated by those of skill in the art that, although the present discussion refers to a "photoconductor drum" as the toner image bearing member, a photoconductor belt might also act as the image bearing member in this invention. It will be further appreciated that various other electrode structures such as sufficiently conductive shim blades, brush rollers, spongy rollers, etc. can be used as an alternative to the blade brushes of the preferred embodiment.

Although the applied potential difference between the transfer nip blade brush 66 and the conductive substrate of drum 10 contribute to the generation of transfer fields, it will be recognized that any bound surface charge present on the photoconductor 12 surface and on the intermediate transfer belt 28 surface will also contribute to the fields created in and around the transfer region. The relative contribution of the applied voltage terms and the surface charge related terms to the transfer fields can be readily described by the equation:

$$V_E = V_B + V_2 - V_3$$

which refers to an "effective applied potential" ($V_E$) for the system, as opposed to just the applied potentials. Thus, the equivalent applied potential $V_E$ at any position near the transfer system of the intermediate transfer system described herein is given by the sum of the potential $V_B$ along the laterally conductive resistive substrate 60 of the intermediate belt 28 at any position of interest and the difference between the potential difference $V_2$ across the overcoating layer 62 of the intermediate transfer belt 28 due to any surface charges present thereat and the potential $V_3$ that a non-contacting electrostatic voltmeter would measure above the drum 10 surface immediately prior to the transfer region.

Biased blade brush 66 applies appropriate potentials to the transfer nip but preferably not to the pre-nip region, so that the desired oscillatory transfer fields can be induced in and not beyond the transfer nip. In particular, the optimal oscillatory transfer field is substantially reduced or eliminated in the pre-nip region and the post-nip region. Thus, brush 66 will preferably be biased and mechanically positioned relative to the transfer nip such that the effective applied potential, $V_E$, referred to previously, will be sufficiently low at large pre-nip gaps (typically greater than 50 microns) to avoid toner transfer at these gaps. Thus, electrostatic image transfer to the intermediate transfer belt 28 is accomplished by effectively eliminating pre-transfer fields in the pre-nip region while generating oscillatory electric fields in the transfer nip. The intermediate transfer belt structure 28 of the present invention, having well-controlled lateral conduction in order to prevent the spreading of the transfer field from the nip region, in combination with a biased transfer nip charging brush 66, has been found to accomplish the objective of rendering oscillatory transfer fields in the transfer nip while minimizing or eliminating the transfer fields in the pre-nip and post-nip regions.

It will be recognized that the oscillatory electric field described herein will nonetheless exhibit the necessary transfer nip charge polarity such that the toner will be transferred to the intermediate transfer belt 28. For example, if positively charged toner is used in the system then, by applying a negative charge in the transfer nip area opposite the positively charged toner, a transfer field will be generated in the transfer nip, thereby inducing toner transfer from the image bearing surface 12 to the intermediate belt 28. It will thus be appreciated that the voltage output from bias source 67 can be set relative to system parameters to provide appropriate results. It will be further appreciated that the charge polarity of the toner and that the polarities shown and intimated, are described for illustration purposes only such that the present description applies equally to systems using different polarity schemes.

FIG. 3 shows the electrical circuit of the biasing source 67 constructed to supply the oscillatory bias voltage as described above. The electrical circuit of the biasing source 67 described above is roughly composed of a controller 110 and a power unit 111. The controller 110 comprises a control circuit 112 for outputting digital signals and frequency information 114 to a waveform generation circuit 113 and outputting a signal to a DC voltage generating circuit 115 in the power unit 111. In response to the digital signal from the control circuit 112, the waveform generating circuit 113 generates an AC voltage of predetermined waveform and frequency. The AC voltage of the predetermined waveform and frequency generated by the waveform generating circuit 113 is amplified to an AC voltage having a predetermined peak-to-peak voltage by an amplifier circuit 116 in the power unit 111. It is then superimposed with a DC voltage generated by the DC voltage generating circuit 115 to generate the predetermined oscillatory bias voltage in the amplifier circuit 116 to be applied to the biased blade brush 66.

The control circuit 112 controls the frequency information outputted to the waveform generating circuit 113 and the strength of the DC and AC components of the oscillatory bias voltage, which are characteristics of operation that are described below for optimal transfer of toner.

The electrodynamic field strength is controlled across the nip from the pre-nip to the post-nip regions the drum 10 extending along the direction of motion of the photoconductive drum 10 and perpendicular to the intermediate transfer belt 28. The waveform of the oscillating component of the oscillatory bias voltage is preferably sinusoidal but need not be a sine wave. It may be a rectangular wave, a triangular wave, a pulse wave or the like as long as it is a cyclic AC waveform. It contains voltage created by periodically increasing and decreasing the DC component.

In the illustrated embodiment, the biased blade brush 66 is operated by the biasing source 67 to apply the oscillatory electric field in the transfer nip. As a result, the portion of the toned image present in the transfer nip is subjected to repeated transfer and back-transfer forces, resulting in fluidization, wherein the toner particles are agitated free of the surface of the drum 10. A significant proportion of such toner particles would otherwise be attracted to the drum 10 surfaces under traditional electrostatic-transfer conditions, due to toner adhesion forces.

The oscillatory electric field is established such that the electric field strength at the nip entrance and nip exit does not exceed a level sufficient to degrade the integrity of the toner image. The oscillatory electrical field strength is optimally a minimum at the nip entrance, increases to a peak at approximately the center of the transfer nip, and diminishes to a minimum at the nip exit. Accordingly, as the fluidized toner image is carried to the nip exit, and in order for the fluidized toner image to ultimately transfer to the intermediate transfer belt 28, it is also important that the oscillation of the applied electric field diminishes to a level that is appropriate for the transfer direction.

In order to effectively fluidize the toner image through the transfer/back transfer motion, mere application of an oscillatory electric field having a large amplitude is insufficient. The field direction of the oscillatory electric field across the toner image layer also has to be subject to at least a partial reversal. For optimal performance in most applications, complete field reversal during the oscillatory phase is recommended.

Suitable frequencies of the oscillatory field can be applied in the range of one hundred Hertz (Hz) to one megahertz (MHz) depending upon the electrical response of the belt 28 and biased blade brush 66. In preferred embodiments, frequencies in the range of one kilohertz (kHz) to several hundred kHz have been found useful.

Selection of the AC frequency depends upon the belt conductivity, dielectric thickness and the conductivity of the bias electrode. In general, the electrode should be conductive and the belt can be more conductive than that of a traditional electrostatic transfer system. A semiconductive belt has also been shown to be operable if the dielectric thickness is small.

The minimum threshold field strength for effecting the desired transfer and back-transfer of toner in the fluidized state will be understood to be effected by a minimum bias that is sufficient to achieve uni-directional fields across the toner image. As illustrated, a full field polarity reversal is achieved, and the mean direct current (DC) field is preferably provided as a unidirectional field corresponding to the desired toner transfer direction.

Certain maximum and minimum levels of the oscillatory field strength, within the nip as well as in the pre-nip and post-nip regions, are necessary for optimal toner transfer. In addition to effecting full field polarity reversal, the mean direct current (DC) field should be relatively small. In contrast to a conventional electrostatic transfer system having applied voltages ranging between 1000 and 1500 volts, a mean direct current (DC) voltage potential difference of 600V to 800V has been found to yield excellent transfer efficiency. In another aspect of the invention, zero or minimal retransfer is accomplished due to the low mean direct current (DC) field strength; otherwise, the onset of air breakdown at the exit nip will counteract the nearly zero adhesion of toner. It has also been observed that an oscillatory field strength sufficient to cause an excessive amount of transfer/back-transfer motion can lead to severe image disturbances.

In a traditional transfer system, the lateral conduction of the belt is well controlled in order to prevent the spreading of the transfer field from the nip contact into the pre-nip region, because toner movement in the pre-nip gap will severely affect image sharpness. In the present invention, the electrostatic fields in the transfer nip have two (DC and AC) components. The field spreading that occurs due to the DC component is similar to that of a conventional transfer system, whereas the AC component provided in the embodiments of the invention will be understood to exhibit much less field spreading. Also, as the frequency of the AC component increases, there is less field spreading due to lateral conduction.

In comparison to a conventional transfer system, the transfer system of the present invention uses a weaker DC field and exhibits less spreading of the AC field and as a result there is a reduced field strength in the portions of the transfer nip that are proximate to the pre-nip and post-nip regions. Such reduced field strength decreases according to the distance from the center of the transfer nip.

With reference to the illustrated embodiment, the highest field strength occurs in the transfer nip area as a result of the applied potential difference provided by bias blade brush 66, which is preferably located generally at the center of the transfer nip, and that the electrostatic field (especially the AC component) in the pre-nip and post-nip regions is significantly weaker. Accordingly, it can be useful to utilize a resistive-backed intermediate transfer belt that is especially conductive in a lateral direction so as to generate the desired electrostatic fields in the transfer nip rather than in the pre-nip and post-nip regions.

It will be appreciated that the conductive substrate of drum 10 could be replaced by a laterally conductive resistive material wherein stationary conductive biasing electrodes similar to the conductive blade brush electrode of the present invention could be positioned inside the drum 10 to provide the high transfer nip voltage/low pre-nip voltage results provided by the present invention. However, it is noted that the resistivity range for such a laterally conductive resistive drum configuration will typically be higher than the laterally conductive resistive belt of the present invention, due to the fact that the thickness requirements for a drum are much greater than the thickness of a belt. Typically, a belt will have a thickness of approximately 0.005 inches while a drum will have a thickness of approximately 0.05 inches.

The embodiments described herein may be found useful in systems for multi-color and tandem color electrostatographic printing. In multi-color electrostatographic printing, rather than forming a single latent image on the photoconductive surface, successive latent images corresponding to different colors are created. Each single-color latent electrostatic image is developed with a correspondingly colored toner. This process is repeated for a plurality of cycles. Each single-color toned image is superimposed over the previously transferred single-color toned image(s) when transferred to a copy sheet. This creates a multilayered toned image on the copy sheet. Thereafter, the multilayered toned image is permanently fixed to the copy sheet, creating a full-color copy.

In tandem color printing, to which the present invention relates, four imaging drum systems are generally used. Each imaging drum system separately charges the respective photoconductive drum, forms a latent electrostatic image on the respective drum, develops a toned image on the respective drum and then transfers the toned image to an intermediate belt. In this manner, yellow, magenta, cyan and black toned images are separately transferred to the intermediate transfer belt.

Generally, the toned images are separately transferred to the belt and superimposed on top of each other to form a four-layered toned image on the intermediate belt. When properly superimposed, these four toned images are capable of producing a wide variety of colors. Therefore, it is important to properly align and register the toned images on the belt. Each tone layer transferred to the intermediate belt is subjected to numerous electrostatic fields along the intermediate belt. Because of the electrostatic fields, the toned layers lose some of their charge, thereby decreasing the efficiency of the subsequent transfer to the copy sheet. It is therefore important to charge each toned layer to a sufficient level to enable efficient transfer to the copy sheet.

Additionally, in tandem color printing, the toner often splatters in pre-nip regions of subsequent imaging systems. This occurs because conventional transferring devices in each imaging system sometimes extends the transfer electrostatic field into the pre-nip region. Embodiments of the present invention can yield improved performance in this regard.

It is, therefore, evident that there has been provided, in accordance with the present invention, an electrophotographic printing apparatus that fully satisfies the aims and advantages of the invention as hereinabove set forth. While this invention has been described in conjunction with a preferred embodiment thereof, it is evident that many alternatives, modifications, and variations will be apparent to those skilled in the art. Accordingly, the present application for patent is intended to embrace all such alternatives, modifications and variations as are within the broad scope and spirit of the appended claims.

What is claimed is:

1. An apparatus for transferring charged toner particles from an image support surface to a substrate, comprising:

a substrate positioned to have at least a portion thereof adjacent said image support surface in a transfer region, defining a transfer nip, a pre-nip region having a pre-transfer nip gap, and a post-nip region having a post-transfer nip gap; and a transfer station, located adjacent said transfer region, for applying an oscillatory bias voltage potential difference between said image support surface and said substrate in said transfer region so as to effect an oscillatory electric field therein, wherein the oscillatory electric field exhibits an oscillatory component having alternating polarity and respective bidirectional field strength that is sufficient to effect repeated transfer and back transfer of the toner within the transfer nip with respect to the substrate, and a constant component having a single polarity and a respective unidirectional field strength sufficient to effect ultimate toner particle transfer to the substrate, wherein the oscillatory component diminishes to a level that allows the constant component to effect the ultimate toner particle transfer to the substrate, such that high transfer efficiency and stable toner transfer are achieved.

2. The apparatus of claim 1, wherein the bi-directional field strength is substantially greater in the transfer nip than in the pre-nip and post-nip regions.

3. The apparatus of claim 1, wherein the field direction of the oscillatory electric field is subject to at least a partial field reversal.

4. The apparatus of claim 1, wherein the field direction of the oscillatory electric field is subject to complete field reversal.

5. The apparatus of claim 1, wherein a frequency of the oscillatory component is provided in the range of one hundred Hertz (Hz) to one megahertz (MHz).

6. The apparatus of claim 1, wherein a frequency of the oscillatory component is provided in the range of one kilohertz (kHz) to five hundred kHz.

7. The apparatus of claim 1, wherein the substrate is an intermediate transfer member.

8. The apparatus of claim 1, wherein the substrate further comprises a laterally conductive member.

9. The apparatus of claim 1, wherein the unidirectional field strength is provided by a mean direct current (DC) voltage potential difference in the range of 600V to 800V.

10. A method for transferring charged toner particles from an image support surface to a substrate, comprising:

providing a substrate positioned to have at least a portion thereof adjacent said image support surface in a transfer region, defining a transfer nip, a pre-nip region having a pre-transfer nip gap, and a post-nip region having a post-transfer nip gap; and applying an oscillatory bias voltage potential difference between said image support surface and said substrate in said transfer region so as to effect an oscillatory electric field therein, wherein the oscillatory electric field exhibits an oscillatory component having alternating polarity and respective bidirectional field strength that is sufficient to effect repeated transfer and back transfer of the toner within the transfer nip with respect to the substrate, and a constant component having a single polarity and a respective unidirectional field strength sufficient to effect ultimate toner particle transfer to the substrate, wherein the oscillatory component diminishes to a level that allows the constant component to effect the ultimate toner particle transfer to the substrate, such that high transfer efficiency and stable toner transfer are achieved.

11. The method of claim 10, wherein the bidirectional field strength is substantially greater in the transfer nip than in the pre-nip and post-nip regions.

12. The method of claim 10, wherein the field direction of the oscillatory electric field is subject to at least a partial field reversal.

13. The method of claim 10, wherein the field direction of the oscillatory electric field is subject to complete field reversal.

14. The method of claim 10, wherein a frequency of the oscillatory component is provided in the range of one hundred Hertz (Hz) to one megahertz (MHz).

15. The method of claim 10, wherein a frequency of the oscillatory component is provided in the range of one kilohertz (kHz) to five hundred kHz.

* * * * *